US011554070B2

(12) United States Patent
Achiwa et al.

(10) Patent No.: US 11,554,070 B2
(45) Date of Patent: Jan. 17, 2023

(54) WALKING ASSIST DEVICE

(71) Applicant: JTEKT CORPORATION, Osaka (JP)

(72) Inventors: Fumitaka Achiwa, Nagoya (JP); Yoshiyuki Shibata, Toyota (JP); Kouji Nagumo, Anjo (JP); Kimihiro Onishi, Kasugai (JP); Tomomi Nishida, Toyoake (JP)

(73) Assignee: JTEKT CORPORATION, Kariya (JP)

( * ) Notice: Subject to any disclaimer, the term of this patent is extended or adjusted under 35 U.S.C. 154(b) by 965 days.

(21) Appl. No.: 16/285,289

(22) Filed: Feb. 26, 2019

(65) Prior Publication Data

US 2019/0262215 A1 Aug. 29, 2019

(30) Foreign Application Priority Data

Feb. 27, 2018 (JP) ..... JP2018-033291

(51) Int. Cl.
*A61H 3/04* (2006.01)
*A63B 23/035* (2006.01)
(Continued)

(52) U.S. Cl.
CPC ..... *A61H 3/04* (2013.01); *A61H 1/0277* (2013.01); *A61H 1/0281* (2013.01);
(Continued)

(58) Field of Classification Search
CPC ..... A61H 3/04; A63B 22/20; A63B 22/00; B62B 4/0023; B62B 4/0026; B62B 4/0056; A62B 5/0026; A62B 5/0056
See application file for complete search history.

(56) References Cited

U.S. PATENT DOCUMENTS 6,522,255 B1 * 2/2003 Hsieh ..... A63B 22/00 340/432
9,770,380 B1 * 9/2017 Dalton ..... A61H 3/04
(Continued)

FOREIGN PATENT DOCUMENTS

CN 104856843 A 8/2015
DE 10 2016 201 743 B3 4/2017
(Continued)

OTHER PUBLICATIONS

Extended European Search Report dated Jul. 1, 2019 in European Patent Application No. 19159124.7, citing documents AA and AO-As therein, 8 pages.
(Continued)

*Primary Examiner* — Justine R Yu
*Assistant Examiner* — Alexander Morales
(74) *Attorney, Agent, or Firm* — Oblon, McClelland, Maier & Neustadt, L.L.P.

(57) ABSTRACT

A walking assist device includes: a pair of right and left handles that are movable back and forth with respect to a frame in accordance with arm swing performed during walk of a user; rails on which the handles are provided and which limit movement of the handles in a movable range in accordance with arm swing performed during the walk of the user; a handle information acquisition unit that acquires information related to movement of the handles; and a control unit that controls a drive unit in accordance with the information from the handle information acquisition unit.

6 Claims, 10 Drawing Sheets

(51) Int. Cl.

| | |
|---|---|
| ***A63B 21/00*** | (2006.01) |
| ***A61H 1/02*** | (2006.01) |
| ***A63B 23/04*** | (2006.01) |
| ***A63B 23/12*** | (2006.01) |
| ***A63B 22/20*** | (2006.01) |
| ***A63B 22/00*** | (2006.01) |
| ***A63B 21/005*** | (2006.01) |

(52) U.S. Cl.

CPC ..... *A63B 21/4045* (2015.10); *A63B 21/4047* (2015.10); *A63B 23/03516* (2013.01); *A63B 23/03533* (2013.01); *A63B 23/03575* (2013.01); *A63B 23/04* (2013.01); *A63B 23/12* (2013.01); *A63B 23/1209* (2013.01); *A61H 2003/043* (2013.01); *A61H 2003/046* (2013.01); *A61H 2201/0173* (2013.01); *A61H 2201/1215* (2013.01); *A61H 2201/1261* (2013.01); *A61H 2201/14* (2013.01); *A61H 2201/1635* (2013.01); *A61H 2201/1664* (2013.01); *A61H 2201/1669* (2013.01); *A61H 2201/1676* (2013.01); *A61H 2201/5007* (2013.01); *A61H 2201/5061* (2013.01); *A61H 2201/5064* (2013.01); *A61H 2201/5069* (2013.01); *A61H 2201/5071* (2013.01); *A61H 2201/5079* (2013.01); *A61H 2201/5082* (2013.01); *A61H 2201/5084* (2013.01); *A61H 2203/0406* (2013.01); *A61H 2205/06* (2013.01); *A61H 2205/065* (2013.01); *A61H 2230/06* (2013.01); *A61H 2230/25* (2013.01); *A61H 2230/50* (2013.01); *A63B 21/0058* (2013.01); *A63B 21/4035* (2015.10); *A63B 22/0012* (2013.01); *A63B 22/20* (2013.01); *A63B 23/0405* (2013.01); *A63B 2022/0094* (2013.01)

(56) References Cited

U.S. PATENT DOCUMENTS

| | | | | |
|---|---|---|---|---|
| 9,795,825 | B2 * | 10/2017 | Johnson | A63B 21/4045 |
| 2015/0053042 | A1 * | 2/2015 | Shirakawa | A61H 3/04 74/523 |
| 2016/0151675 | A1 * | 6/2016 | Chazalon | A63B 21/0058 482/5 |
| 2017/0001656 | A1 * | 1/2017 | Katayama | A61H 3/04 |
| 2017/0129523 | A1 * | 5/2017 | Hane | B62B 5/0414 |
| 2017/0326019 | A1 * | 11/2017 | Bramsiepe | B62B 5/064 |
| 2019/0262216 | A1 * | 8/2019 | Kanaya | A63B 23/03533 |
| 2019/0262217 | A1 * | 8/2019 | Kanaya | A61H 1/0277 |
| 2020/0009003 | A1 * | 1/2020 | Shibata | A63B 21/055 |
| 2020/0078258 | A1 * | 3/2020 | Kanaya | A63B 21/023 |
| 2020/0230015 | A1 * | 7/2020 | Shibata | A61H 3/04 |

FOREIGN PATENT DOCUMENTS

| | | | | | |
|---|---|---|---|---|---|
| EP | 2 845 785 | A1 | | 3/2015 | |
| JP | 5-329186 | | | 12/1993 | |
| JP | 2009-106446 | | | 5/2009 | |
| JP | 2011115323 | A | * | 6/2011 | |
| JP | 5706016 | B2 | | 4/2015 | |
| JP | 2017-12546 | A | | 1/2017 | |
| KR | 10-0717397 | B1 | | 5/2007 | |
| NZ | 563921 | A | * | 12/2009 | A61H 1/00 |
| WO | WO 2016/136370 | A1 | | 9/2016 | |
| WO | WO 2017/079491 | A1 | | 5/2017 | |

OTHER PUBLICATIONS

Office Action dated Oct. 26, 2021 in corresponding Japanese Patent Application No. 2018-033291 (English Translation only), citing documents AO and OP therein, 3 pages.

Chinese Office Action dated Jun. 29, 2022 in Chinese Patent Application No. 201910136991.9 (submitting English translation only), 7 pages.

* cited by examiner

FIG. 7

| OUTPUT FROM EACH DETECTION UNIT / WALKING MODE | RIGHT HANDLE TILT | LEFT HANDLE TILT | RIGHT HANDLE POSITION | LEFT HANDLE POSITION | FRONT-REAR AMPLITUDE |
|---|---|---|---|---|---|
| STRAIGHT TRAVEL | – | – | FRONT SIDE → REAR SIDE | REAR SIDE → FRONT SIDE | EQUAL BETWEEN RIGHT AND LEFT |
| | – | – | REAR SIDE → FRONT SIDE | FRONT SIDE → REAR SIDE | EQUAL BETWEEN RIGHT AND LEFT |
| RIGHT TURN | – | INWARD TILT | – | – | RIGHT AMPLITUDE > LEFT AMPLITUDE |
| LEFT TURN | INWARD TILT | – | – | – | RIGHT AMPLITUDE < LEFT AMPLITUDE |

WALKING ASSIST DEVICE

The disclosure of Japanese Patent Application No. 2018-033291 filed on Feb. 27, 2018 including the specification, drawings and abstract, is incorporated herein by reference in its entirety.

BACKGROUND OF THE INVENTION

1. Field of the Invention

The present invention relates to a walking assist device.

2. Description of the Related Art

In order for a user that can walk on his/her own to perform training for high-quality natural walk, it is very important to swing his/her arms correctly in synchronization with his/her legs in a correct posture with his/her body trunk straight without leaning on a walker.

Japanese Patent Application Publication No. 2009-106446 (JP 2009-106446 A), for example, describes a walking cart 110 (corresponding to the walking assist device) that includes a pair or right and left front wheels 160F, rear wheels 160B, main frames 140, side frames 130, sliders 122, handles 120, and connecting rods 132 as illustrated in FIG. 9. The sliders 122, to which the handles 120 are fixed, are slidable back and forth along the side frames 130. The sliders 122 are connected to the rear wheels 160B via the connecting rods 132. Consequently, when a user slides the right and left sliders 122 alternately back and forth by walking while grasping the right and left handles 120 with his/her right and left hands and swinging his/her arms, the right and left rear wheels 160B are rotationally driven. That is, the walking cart moves together with the user who walks while swinging his/her arms, and the power source of the walking cart is the force of the user to swing his/her arms back and forth.

Japanese Patent Application Publication No. 5-329186 (JP 5-329186 A) describes a walking helping device 210 (corresponding to the walking assist device) that includes a mobile body 250 (corresponding to the frame), wheels 260FR and 260FL, a follower wheel 260R, grips 220R and 220L (corresponding to the handles) to be grasped by a user, force detectors 234R and 234L that detect a force in the walking direction, a power source 200B, and a controller 240 as illustrated in FIG. 10. With the walking helping device 210, when the user moves the grips 220R and 220L in the direction he/she desires while grasping the grips 220R and 220L, a force applied to the grips 220R and 220L is detected by the force detectors 234R and 234L to be transmitted to the controller 240. The controller 240 controls the speed of the walking helping device 210 in accordance with the applied force.

In the walking cart 110 described in JP 2009-106446 A, as illustrated in FIG. 9, the width of front-rear swing of the arms is fixed by a link mechanism constituted by the handles 120, the sliders 122, the connecting rods 132, and the rear wheels 160B, irrespective of the stride length. Thus, it is difficult for the user to adjust motion of the legs (stride length) and motion of the arms (arm swing width) in conjunction with each other. In order to perform training for high-quality natural walk, the timing of arm swing preferably matches the walking pitch of the user. Since the force of the user to swing his/her arms back and forth is the power source of the walking cart 110, a relatively large load acts on the user. While the walking cart 110 is suitable to recover the function of swinging arms powerfully, the walking cart 110 is not suitable for training for high-quality natural walk, in which the user swings his/her arms correctly in synchronization with his/her legs in a correct posture with his/her body trunk straight without leaning on a walker.

In the walking helping device 210 described in JP 5-329186 A, meanwhile, a power source is provided, and thus a relatively small load acts on the user. However, the user cannot swing his/her arms correctly in synchronization with his/her legs, and thus the walking helping device 210 is not suitable for training for high-quality natural walk, in which the user swings his/her arms correctly in synchronization with his/her legs in a correct posture with his/her body trunk straight without leaning on a walker.

SUMMARY OF THE INVENTION

It is an object of the present invention to provide a walking assist device that can reduce a burden on a user, and that can assist the user in performing training for high-quality natural walk, in which the user swings his/her arms correctly in synchronization with his/her legs in a correct posture with his/her body trunk straight.

An aspect of the present invention provides a walking assist device including:

- a frame;
- a plurality of wheels provided at a lower end of the frame and including at least one drive wheel;
- a drive unit that drives the drive wheel;
- a battery that causes the drive unit to operate;
- a handle that is grasped by a user and that is movable back and forth with respect to the frame in accordance with arm swing performed during walk of the user;
- a handle guide unit on which the handle is provided and which guides the handle in a movable range in accordance with the arm swing performed during the walk of the user;
- a handle information acquisition unit that acquires information on the handle; and
- a control unit that controls the drive unit on the basis of the information which is acquired by the handle information acquisition unit.

With the walking assist device described above, the drive wheel of the walking assist device is driven in accordance with swing of the arms of the user by controlling the drive unit in accordance with information related to movement of the handle which is grasped by the user (e.g. the width of front-rear swing), which allows movement without the user pushing the walking assist device. Thus, it is possible to reduce a burden on the user. The arm swing width is not fixed, and it is only necessary for the user to swing his/her arms with a natural swing width that matches his/her own stride length. Thus, it is possible to appropriately assist the user in performing training for high-quality natural walk, in which the user swings his/her arms correctly in synchronization with his/her legs in a correct posture with his/her body trunk straight.

BRIEF DESCRIPTION OF THE DRAWINGS

The foregoing and further features and advantages of the invention will become apparent from the following description of example embodiments with reference to the accompanying drawings, wherein like numerals are used to represent like elements and wherein:

FIG. 7 illustrates operation modes of the walking assist device determined on the basis of outputs of various detection units;

DETAILED DESCRIPTION OF EMBODIMENTS

Figure 1:
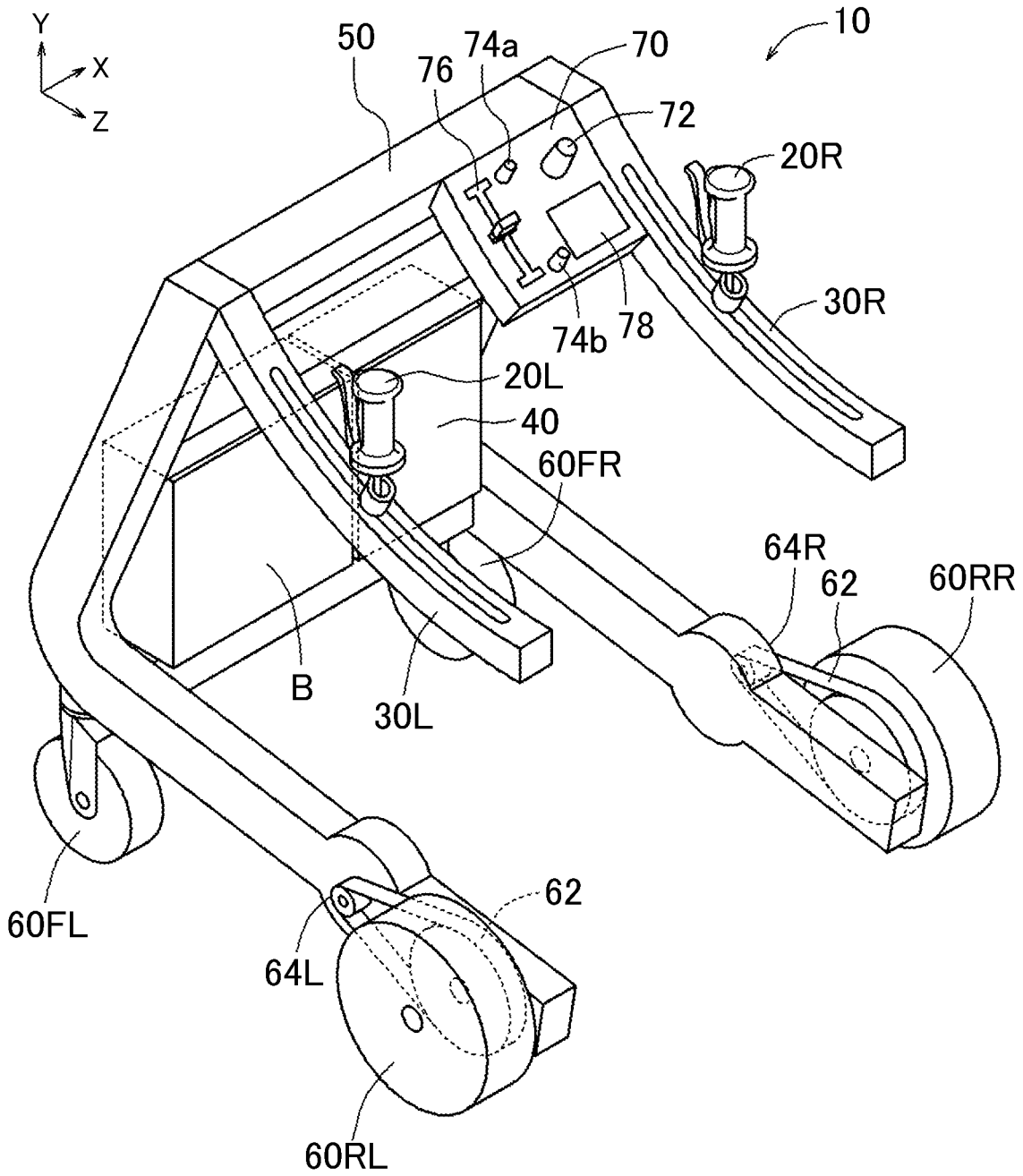
FIG. 1 is a perspective view illustrating the overall configuration of a walking assist device.

An embodiment of the present invention will be described below with reference to the drawings. The X axis, the Y axis, and the Z axis in the drawings are orthogonal to each other. In FIG. 1, the Z-axis direction indicates the direction from a front wheel 60FR to a rear wheel 60RR, and the X-axis direction indicates the direction from the left to the right in a frame 50. In the frame 50, the X-axis direction is referred to as "right", the direction opposite to the X-axis direction is referred to as "left", the direction opposite to the Z-axis direction is referred to as "front", and the Z-axis direction is referred to as "rear". In addition, the Y-axis direction is referred to as "upper", and the direction opposite to the Y-axis direction is referred to as "lower".

A schematic configuration of the embodiment of the present invention will be described with reference to FIG. 1. FIG. 1 illustrates a walking assist device 10 according to the present embodiment. The walking assist device 10 has handles 20R and 20L, rails 30R and 30L, a control unit 40, the frame 50, front wheels 60FR and 60FL, rear wheels 60RR and 60RL, drive units 64R and 64L (e.g. electric motors), a control panel 70, and a battery B.

As illustrated in FIG. 1, the frame 50 is shaped symmetrically in the right-left direction. A user enters a space between the rail 30R and the rail 30L from the open side of the frame 50, and operates the walking assist device 10. The front wheels 60FR and 60FL are follower wheels (turnable caster wheels) provided at the lower front end of the frame 50. The rear wheels 60RR and 60RL are drive wheels provided at the lower rear end of the frame 50, and are driven by the drive units 64R and 64L, respectively, via belts 62. In the example illustrated in FIG. 1, a pair of right and left rear wheels are provided as the drive wheels, and are independently driven by the respective drive units.

The rail 30R and the rail 30L (corresponding to the handle guide units) are provided on the right side and the left side, respectively, of the frame 50. The rails 30R and 30L are provided with the handles 20R and 20L, respectively, which project upward therefrom. The handles 20R and 20L are movable back and forth within the movable range in the rails 30R and 30L, respectively, in accordance with swing of the arms performed during walk of the user. A pair of right and left rails and handles are provided.

As illustrated in FIG. 1, the control panel 70 is provided at a position at which the control panel 70 is easily operable by the user at the upper portion of the frame 50, for example. The control panel 70 has a main switch 72, an assist amount adjustment volume 74*a*, a load amount adjustment volume 74*b*, a movement load control mode switcher 76, and a monitor 78. The main switch 72 is a main switch of the walking assist device 10. When the main switch 72 is turned on, power is supplied from the battery B to the control unit 40 and the drive units 64R and 64L to enable operation of the walking assist device 10. The movement load control mode switcher 76 switches between an assist mode, in which movement of the handles 20R and 20L along the rails 30R and 30L is assisted by motors 32R and 32L (corresponding to the movement load control units) to be discussed later (see FIG. 2), and a load mode, in which a load is applied to such movement. For example, the movement load control mode switcher 76 enables switching among three modes, namely the "assist mode" in which movement of the handles is assisted, the "load mode" in which a load is applied to movement of the handles, and a "normal mode" in which movement of the handles is not assisted or a load is not applied to such movement. The assist amount adjustment volume 74*a* is used to adjust the assist amount in the assist mode. The load amount adjustment volume 74*b* is used to adjust the load amount in the load mode. The monitor 78 is a monitor that displays a variety of states, and displays the charge amount of the battery B, the settings for the various modes, the state of operation, etc., for example.

Figure 2:
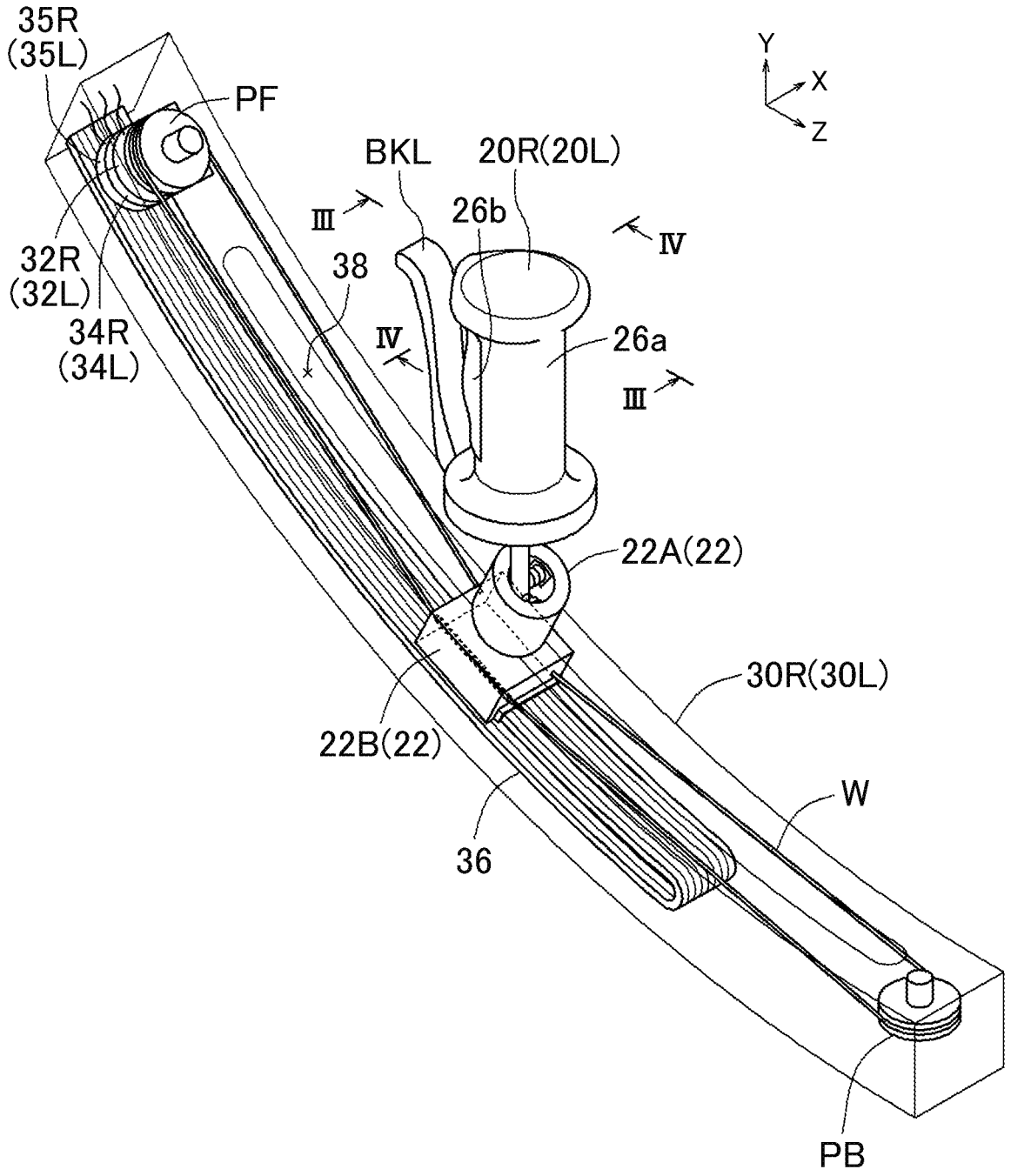
FIG. 2 is a perspective view illustrating the configuration and the function of a handle and a rail.
Figure 3:
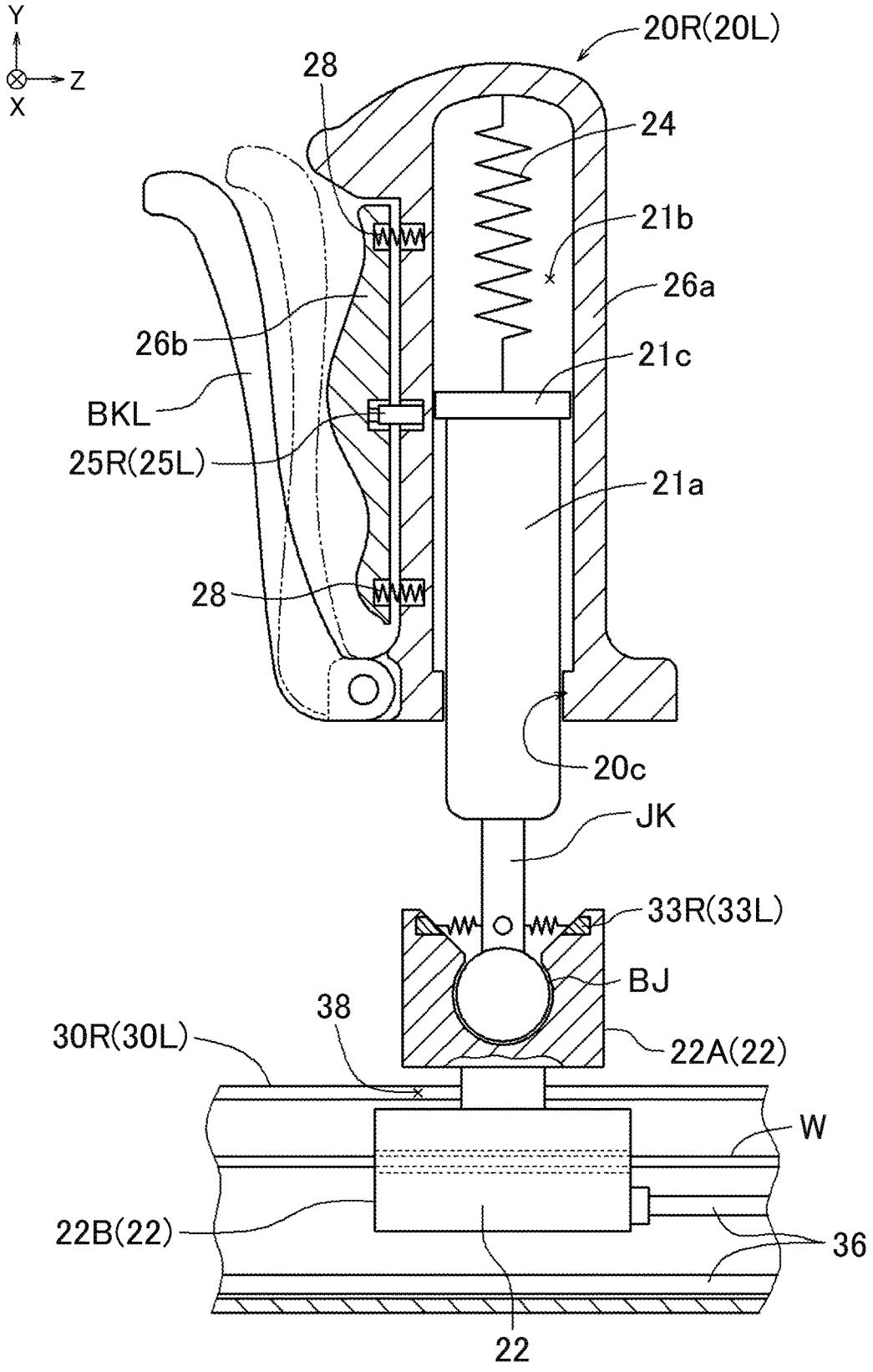
FIG. 3 is a sectional view of the handle as seen in the direction in FIG. 2.
Figure 4:
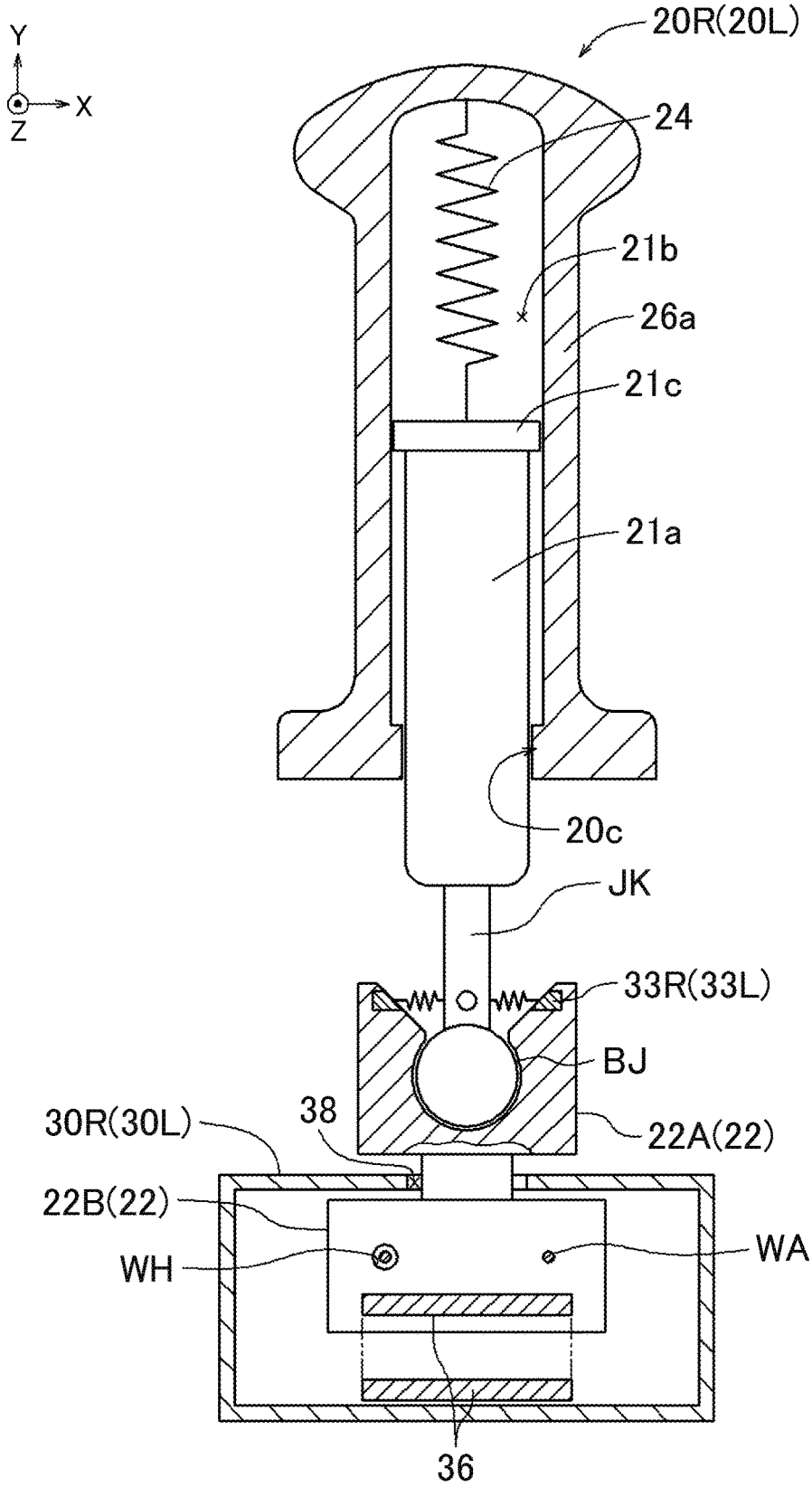
FIG. 4 is a sectional view of the handle as seen in the IV-IV direction in FIG. 2.

The structure of the walking assist device 10 will be described in detail with reference to FIGS. 2 to 4. The walking assist device 10 has a symmetrical structure between the right and the left of the frame 50 except for the control panel 70, the control unit 40, and the battery B. Therefore, the structure on the right side will be mainly described and the structure on the left side will be omitted. FIG. 2 is a perspective view illustrating the configuration and the function of the handle 20R and the rail 30R. FIG. 3 is a sectional view of the handle 20R as seen in the direction in FIG. 2. FIG. 4 is a sectional view of the handle 20R as seen in the IV-IV direction in FIG. 2.

As illustrated in FIG. 2, the rail 30R has the handle 20R, pulleys PB and PF, and a wire W. The rail 30R is shaped to be concavely curved upward, and has a rail slit portion 38 that opens upward and that extends along the front-rear direction. The rail 30R is provided with the pulleys PB and PF at both ends in the front-rear direction. The wire W is wound around the pulley PF, which is provided on the front side, and the pulley PB, which is provided on the rear side, so that the pulleys PF and PB are rotated in conjunction with each other. A motor 32R, a right handle position detection unit 34R (e.g. an encoder), and a handle movement limiting unit 35R are provided coaxially with the pulley PF. As illustrated in FIG. 4, the wire is fixed to a wire connection portion WA of an anchor portion 22B, and the wire is inserted through a wire hole WH without being fixed. The handle 20R is connected to the anchor portion 22B. Consequently, the motor 32R can assist movement of the handle 20R, or apply a load to movement of the handle 20R, by rotating the pulley PF to rotate the wire W between the pulleys. The right handle position detection unit 34R outputs the amount of rotation of the pulley PF which accompanies movement of the handle 20R on the rail 30R, that is, the amount of movement of the handle 20R, to the drive control unit 40.

As illustrated in FIG. 3, the handle 20R has a handle shaft portion 21*a*, a shaft portion fitting hole 21*b*, a slider 22, a grip portion 26*a*, a switch grip portion 26*b*, and a brake lever BKL. The slider 22 is composed of a handle holding portion 22A and the anchor portion 22B.

As illustrated in FIG. 3, one end of an urging unit 24 is connected to the handle shaft portion 21*a*, and the other end thereof is connected to the bottom portion of the shaft portion fitting hole 21*b*. A flange portion 21*c* that extends in the circumferential direction is provided at the end portion of the handle shaft portion 21*a* to which the urging unit 24 is connected. An inner flange portion 20*c* is provided on an inside wall surface at an opening of the shaft portion fitting hole 21*b*. Consequently, the grip portion 26*a* is slidable up and down along the longitudinal direction of the handle shaft portion 21*a* without separating from the handle shaft portion 21*a*. That is, the handle 20R has an expansion/contraction mechanism that enables expansion and contraction in the projecting direction.

A handle support shaft JK is provided on the side of the handle shaft portion 21*a* to which the urging unit 24 is not connected. The distal end of the handle support shaft JK is formed in a generally spherical shape, and forms a ball joint together with a recess provided in the handle holding portion 22A. Consequently, the handle 20R can be tilted to the front, rear, right, and left within a range defined by an opening with respect to the handle holding portion 22A (see FIGS. 3 and 4). A right handle tilt detection unit 33R that detects the tilted amount is provided at the opening of the handle holding portion 22A, and disposed on the front, rear, right, and left with respect to the handle support shaft JK. The right handle tilt detection unit 33R may be a pressure sensor that detects a pressure in accordance with expansion and contraction of springs provided between the side surfaces of the handle support shaft JK and the opening of the handle holding portion 22A, for example.

As illustrated in FIG. 3, the switch grip portion 26*b* is provided such that a predetermined gap is formed between the grip portion 26*a* and the switch grip portion 26*b* by grip urging units 28 (e.g. springs). A grasp detection unit 25R is turned on when a pressure is applied with the switch grip portion 26*b* moved toward the grip portion 26*a* when the user grasps the handle 20R, and turned off when a pressure is not applied. The grasp detection unit 25R may be a pressure switch or a push switch, for example.

One end of the brake lever BKL is connected to the lower front side of the grip portion 26*a*. A mechanism that locks rotation of the front wheels 60FR and 60FL and the rear wheels 60RR and 60RL when the brake lever BKL is grasped and pulled toward the grip portion 26*a* by the user, that maintains the locked state, and that unlocks such rotation when the brake lever BKL is further pulled is provided (not illustrated).

As illustrated in FIG. 2, the rail 30R is provided with the handle movement limiting unit 35R which permits and prohibits movement of the handle 20R with respect to the frame 50. The handle movement limiting unit 35R has a lock mechanism that locks rotation of the motor 32R, for example. The handle movement limiting unit 35R prohibits movement of the handle by locking rotation of the motor 32R, and permits movement of the handle with respect to the rail (i.e. with respect to the frame) by unlocking rotation of the motor 32R. For example, a powder brake may be used for the lock mechanism, or a large DC current may be applied to the motor 32R to lock the motor 32R.

As illustrated in FIGS. 2 and 4, one end of the wire W is inserted through the wire hole WH which is provided in the anchor portion 22B, and the other end of the wire W is connected (fixed) to the wire connection portion WA. The handle 20R is movable on the rail 30R with a constricted portion that connects between the handle holding portion 22A and the anchor portion 22B sliding in the rail slit portion 38.

A signal cable 36 transfers detection signals from the grasp detection unit 25R and the right handle tilt detection unit 33R to the control unit 40 with one end of the signal cable 36 connected to the anchor portion 22B and with the other end thereof connected to the control unit 40. The signal cable 36 may be a cable that is flexible such as a flexible cable, for example. The control unit 40 can detect the position of the handle 20R on the rail 30R on the basis of a detection signal from the right handle position detection unit 34R. The control unit 40 can detect the tilted amount of the handle 20R toward any of the front, rear, right, and left directions on the basis of the detection signal from the right handle tilt detection unit 33R. The control unit 40 can detect whether or not the handle 20R is grasped by the user on the basis of the detection signal from the grasp detection unit 25R.

Figure 5:
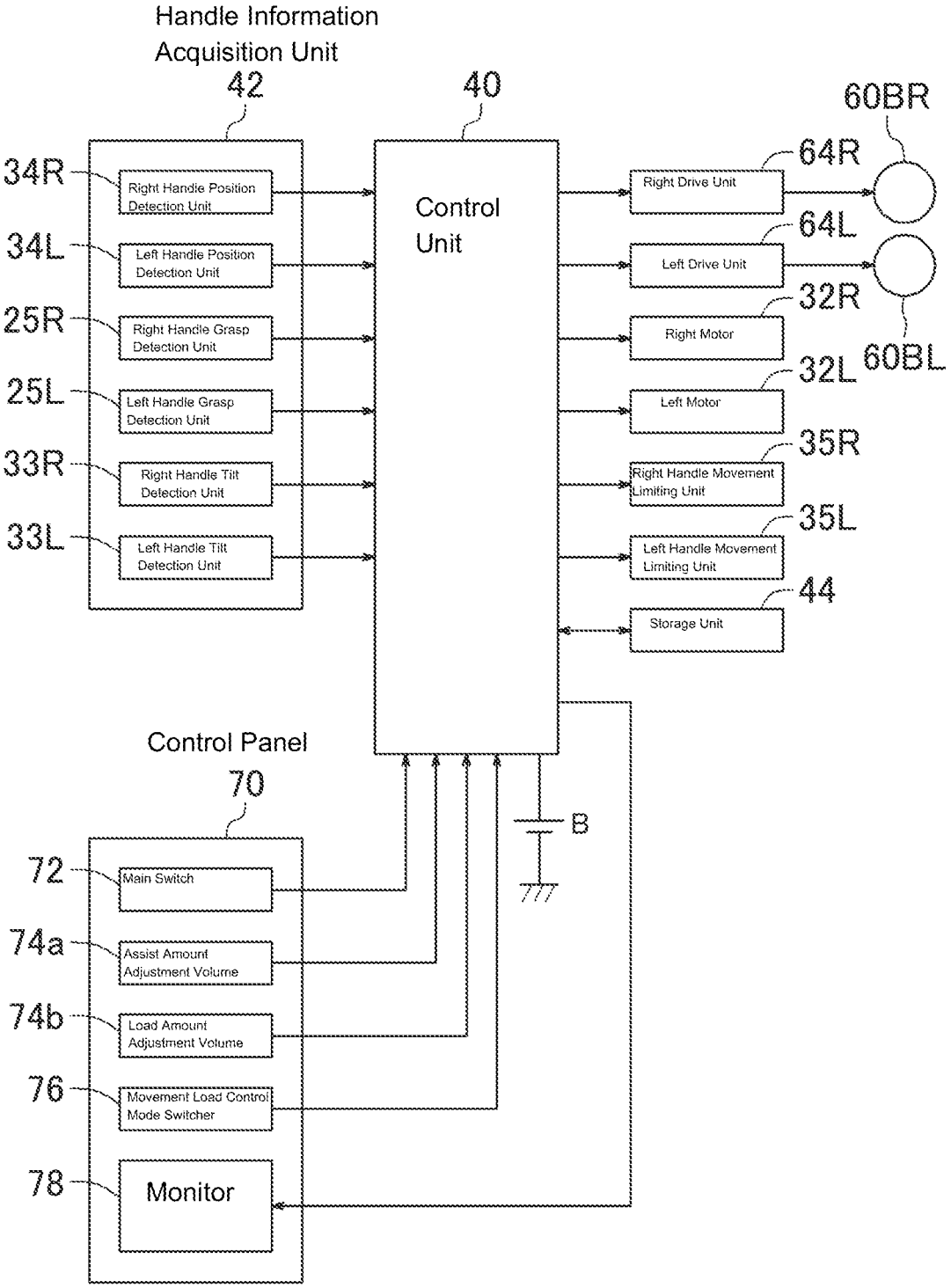
FIG. 5 is a block diagram illustrating inputs and outputs of a control unit of the walking assist device.

The function of the walking assist device 10 will be described in detail with reference to FIGS. 5 to 8. FIG. 5 is a block diagram illustrating inputs and outputs of the control unit 40 (e.g. a control device that includes a CPU) of the walking assist device. As illustrated in FIG. 5, the control unit 40 controls the motors 32R and 32L, the handle movement limiting units 35R and 35L, and the drive units 64R and 64L on the basis of information input from a handle information acquisition unit 42 and information input from the control panel 70. The handle information acquisition unit 42 is composed of grasp detection units 25R and 25L, the right handle tilt detection unit 33R, a left handle tilt detection unit 33L, the right handle position detection unit 34R, and a left handle position detection unit 34L. A storage unit 44 is a device that stores information, and stores and reads information in response to a request from the control unit 40. Signals are input to the control unit 40 from the main switch 72, the assist amount adjustment volume 74*a*, the load amount adjustment volume 74*b*, and the movement load control mode switcher 76 of the control panel 70, and an image signal etc. is output from the control unit 40 to the monitor 78.

Figure 6A:
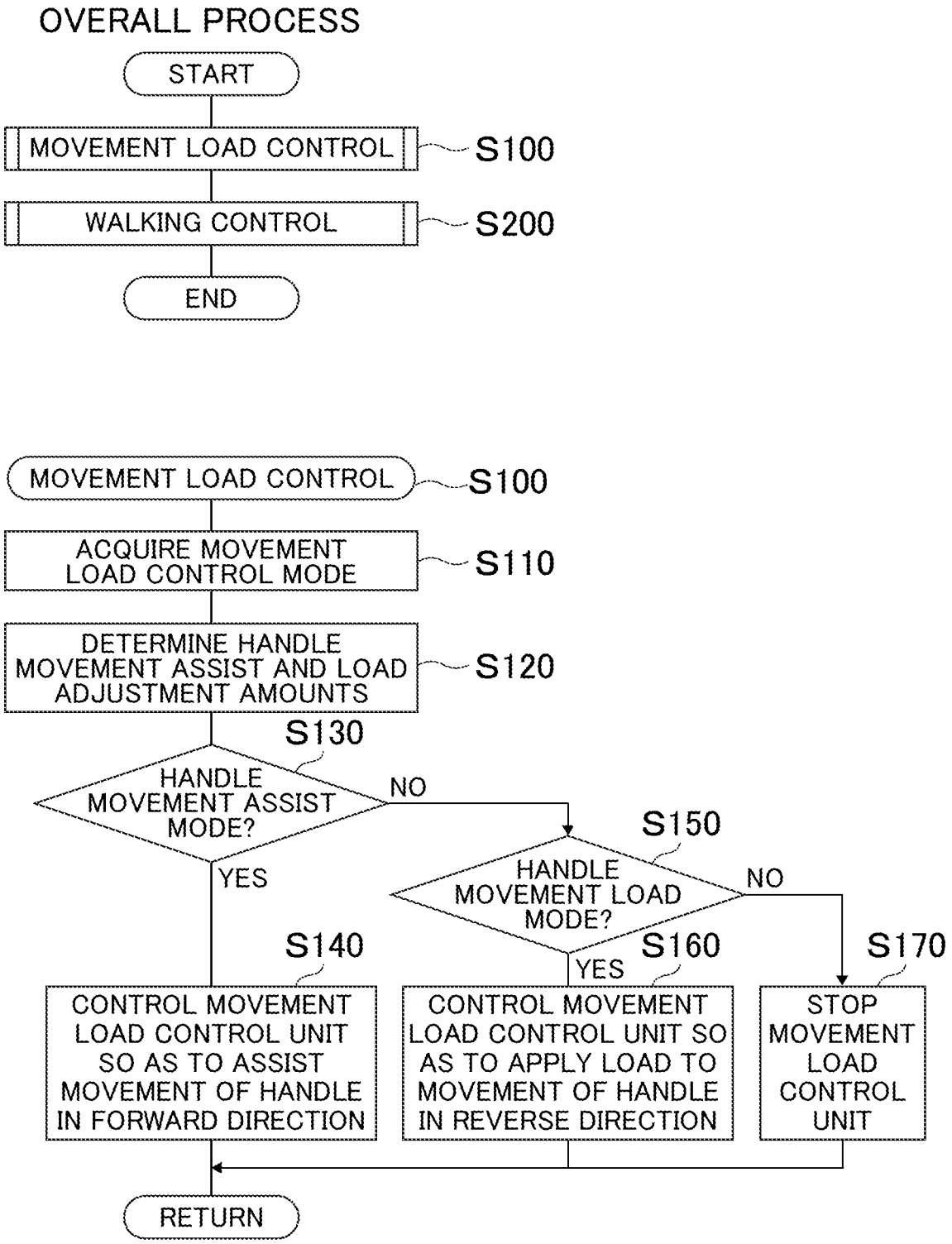
FIG. 6A is a flowchart illustrating the process procedure of the control unit of the walking assist device.
Figure 6B:
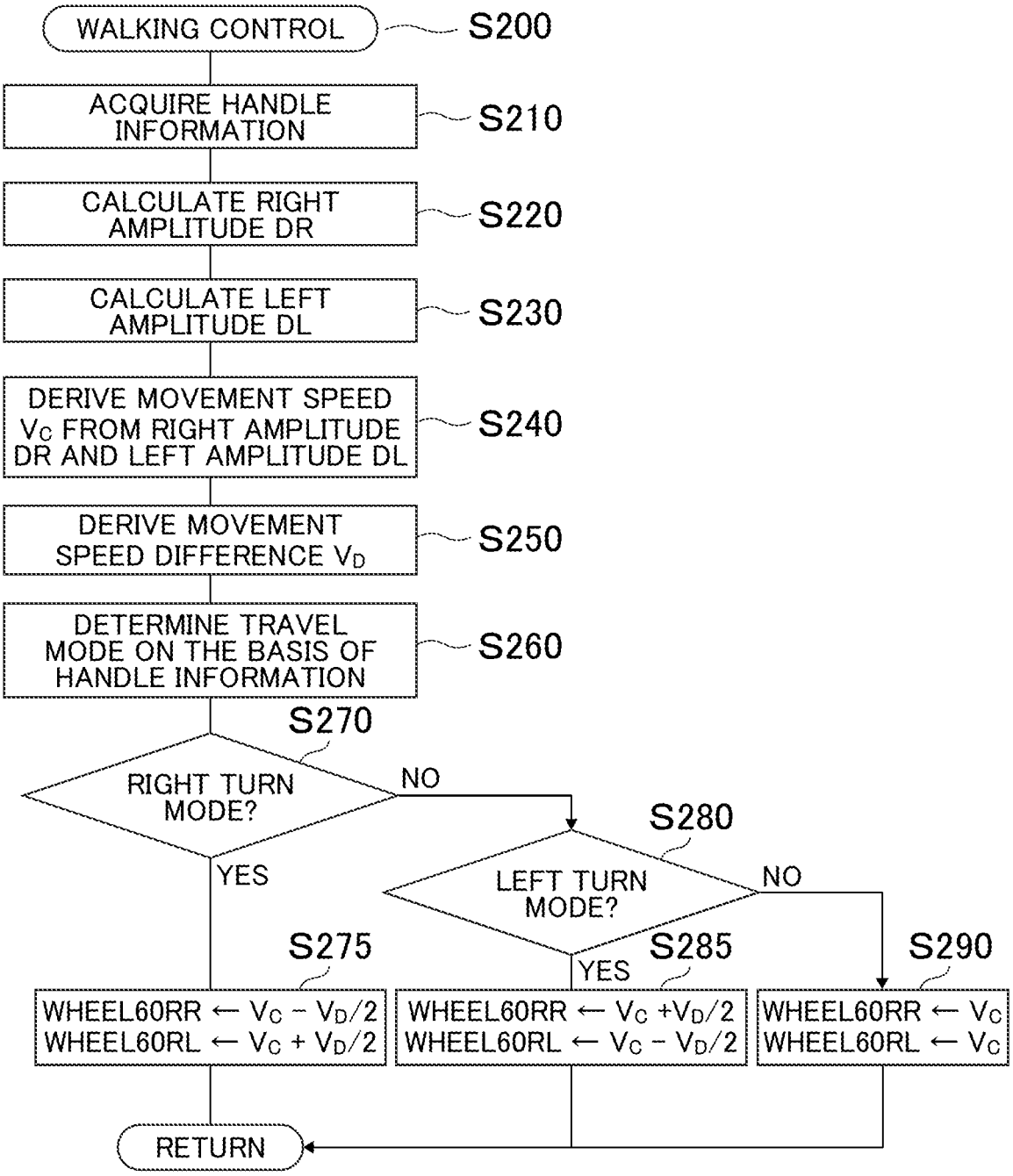
FIG. 6B is a flowchart illustrating the process procedure of the control unit of the walking assist device.

FIG. 6A and FIG. 6B are flowcharts illustrating the process procedure of the control unit 40 of the walking assist device 10. FIG. 7 illustrates the operation modes of the walking assist device 10 determined on the basis of outputs of the various detection units.

When the user turns on the main switch 72, the control unit 40 starts operation. The control unit 40 determines whether or not the handles 20R and 20L are grasped by the user on the basis of information from the grasp detection units 25R and 25L. In the case where it is determined that any of the handles 20R and 20L is not grasped, the control unit 40 controls the handle movement limiting units 35R and 35L so as to prohibit movement of the handles. In the case where it is determined that the handles 20R and 20L are grasped, the control unit 40 controls the handle movement limiting units 35R and 35L so as to permit movement of the handles, and executes the overall process in FIG. 6A and FIG. 6B. The drive units 64R and 64L may include a lock mechanism, and the drive units 64R and 64L may be locked in the case where it is determined that the handles 20R and 20L are not grasped, and the drive units 64R and 64L may be unlocked in the case where it is determined that the handles 20R and 20L are grasped.

The process procedure for the control unit 40 of the walking assist device 10 will be described with reference to the flowchart in FIG. 6A and FIG. 6B. The overall process of the control unit 40 is constituted of processes for movement load control (step S100) and walking control (step S200). The control unit 40 executes the overall process at intervals of a predetermined time (e.g. at intervals of several milliseconds) when started.

Steps in step S100 (movement load control) will be described in detail below.

In step S110, the control unit 40 acquires the state (assist mode, load mode, or normal mode) of the movement load control mode switcher 76, stores the acquired state in the storage unit 44, and proceeds to step S120.

In step S120, the control unit 40 acquires the adjustment amounts of the assist amount adjustment volume 74*a* and the load amount adjustment volume 74*b*, determines a handle movement assist adjustment amount that matches the assist amount adjustment volume 74*a* and a handle movement load adjustment amount that matches the load amount adjustment volume 74*b*, stores the determined adjustment amounts in the storage unit 44, and proceeds to step S130.

In step S130, the control unit 40 proceeds to step S140 in the case where the state of the movement load control mode switcher 76 is the assist mode (Yes), and proceeds to step S150 in the case where the state of the movement load control mode switcher 76 is not the assist mode (No).

In step S140, the control unit 40 controls the motors 32R and 32L (movement load control units) so as to assist movement of the handles 20R and 20L in the forward direction (the same direction as the direction of movement of the handles) with the handle movement assist adjustment amount which is determined in step S120. The control unit 40 finishes the movement load control (step S100), and returns to the overall process. The motors 32R and 32L which assist movement of the handles in step S140 correspond to the assist unit.

In step S150, the control unit 40 proceeds to step S160 in the case where the state of the movement load control mode switcher 76 is the load mode (Yes), and proceeds to step S170 in the case where the state of the movement load control mode switcher 76 is not the load mode (No).

In step S160, the control unit 40 controls the motors 32R and 32L (movement load control units) so as to apply a load with the handle movement load adjustment amount which is determined in step S120 to movement of the handles 20R and 20L in the reverse direction (the direction opposite to the direction of movement of the handles). The control unit 40 finishes the movement load control (step S100), and returns to the overall process. The motors 32R and 32L which apply a load to movement of the handles in step S160 correspond to the load unit.

In step S170, the control unit 40 stops the motors 32R and 32L (movement load control units) (lets the motors 32R and 32L idle). The control unit 40 finishes the movement load control (step S100), and returns to the overall process.

Steps in step S200 (walking control) will be described in detail below.

In step S210, the control unit 40 acquires respective tilts of the handles 20R and 20L (right handle tilt and left handle tilt) from the right handle tilt detection unit 33R and the left handle tilt detection unit 33L, acquires respective positions of the handles 20R and 20L (right handle position and left handle position) on the rails 30R and 30L from the right handle position detection unit 34R and the left handle position detection unit 34L, stores the acquired tilts and positions in the storage unit 44, and proceeds to step S220.

In step S220, the control unit 40 calculates a right amplitude DR from the position of the handle 20R which is stored in the storage unit 44 and the position of the handle 20R which is stored one cycle earlier (during the preceding execution of the overall process), stores the calculated right amplitude DR in the storage unit 44, and proceeds to step S230.

In step S230, the control unit 40 calculates a left amplitude DL from the position of the handle 20L which is stored in the storage unit 44 and the position of the handle 20L which is stored one cycle earlier (during the preceding execution of the overall process), stores the calculated left amplitude DL in the storage unit 44, and proceeds to step S240.

In step S240, the control unit 40 calculates a movement speed $V_C$=(DR+DL)/(predetermined time interval)/2 from the right amplitude DR and the left amplitude DL, and proceeds to step S250. The "predetermined time interval" is the time interval for execution of the overall process.

In step S250, the control unit 40 calculates a movement speed difference $V_D$=|DR−DL|/(predetermined time interval) from the right amplitude DR and the left amplitude DL, and proceeds to step S260.

In step S260, the control unit 40 determines an operation mode (straight travel, right turn, or left turn) on the basis of the respective states indicated in FIG. 7, namely the right handle tilt, the left handle tilt, the right handle position, the left handle position, and the front-rear amplitude, and proceeds to step S270.

As illustrated in FIG. 7, the operation mode is determined on the basis of the respective states of the right handle tilt, the left handle tilt, the right handle position, the left handle position, and the front-rear amplitude. The straight travel mode, in which the walking assist device 10 is caused to travel straight forward, includes a case where the handle 20R is moved from the front side toward the rear side and the handle 20L is moved from the rear side toward the front side with the front-rear amplitude equal between the right side and the left side, and a case where the handle 20L is moved from the front side toward the rear side and the handle 20R is moved from the rear side toward the front side with the front-rear amplitude equal between the right side and the left side, for example. The right turn mode, in which the walking assist device 10 is turned to the right, includes a case where the left handle tilt is "inward tilt", that is, the handle 20L is tilted toward the user, and the front-rear amplitude is larger on the left side than on the right side, for example. The left turn mode, in which the walking assist device 10 is turned to the left, includes a case where the right handle tilt is "inward tilt", that is, the handle 20R is tilted toward the user, and the front-rear amplitude is smaller on the left side than on the right side, for example. The method of determination of the straight travel mode in which it is determined that the user desires straight travel, the right turn mode in which it is determined that the user desires a right turn, and the left turn mode in which it is determined that the user desires a left turn is not limited to the determination method described above.

In step S270, the process proceeds to step S275 in the case where the operation mode is the right turn mode (Yes; in the case where the user desires a right turn), and proceeds to step S280 in the case where the operation mode is not the right turn mode (No).

In step S275, the control unit 40 causes the walking assist device 10 to make a right turn by causing a difference between the respective rotational speeds of the right and left rear wheels by controlling the drive unit 64R such that the speed of the rear wheel 60RR is brought to $(V_C-V_D)/2$ and controlling the drive unit 64L such that the speed of the rear wheel 60RL is brought to $(V_C+V_D)/2$. The control unit 40 finishes the walking control (step S200), and returns to the overall process.

In step S280, the process proceeds to step S285 in the case where the operation mode is the left turn mode (Yes; in the case where the user desires a left turn), and proceeds to step S290 in the case where the operation mode is not the left turn mode (No).

In step S285, the control unit 40 causes the walking assist device 10 to make a left turn by causing a difference between the respective rotational speeds of the right and left rear wheels by controlling the drive unit 64R such that the speed of the rear wheel 60RR is brought to $(V_C+V_D)/2$ and controlling the drive unit 64L such that the speed of the rear wheel 60RL is brought to $(V_C-V_D)/2$. The control unit 40 finishes the walking control (step S200), and returns to the overall process.

In step S290, the control unit 40 causes the walking assist device 10 to travel straight by controlling the drive unit 64R such that the speed of the rear wheel 60RR is brought to $V_C$ and controlling the drive unit 64L such that the speed of the rear wheel 60RL is brought to $V_C$. The control unit 40 finishes the walking control (step S200), and returns to the overall process.

Figure 8:
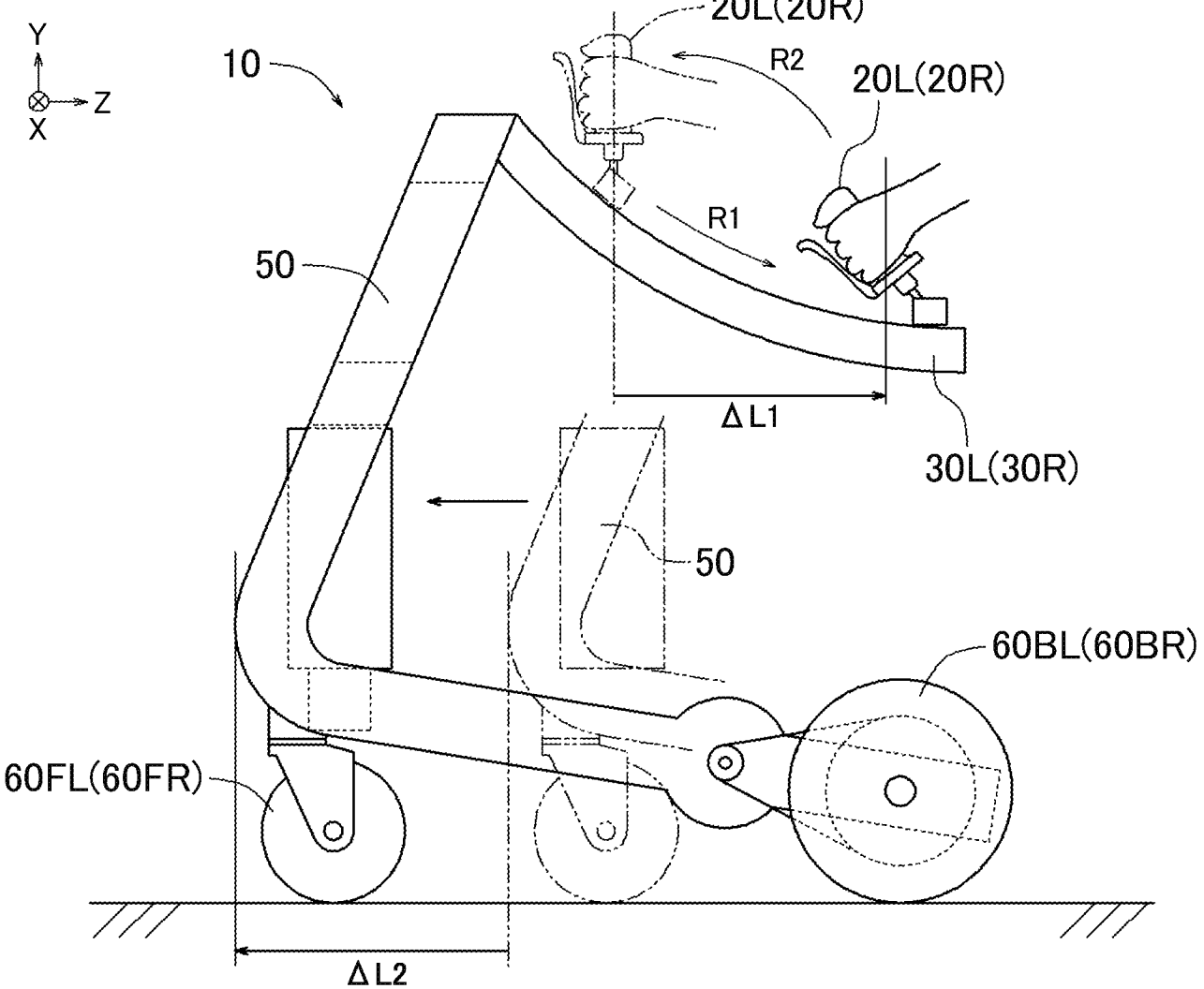
FIG. 8 illustrates the amount of movement of the handle from the front side toward the rear side and the amount of movement of the walking assist device toward the front side which matches the amount of movement of the handle.
Figure 9:
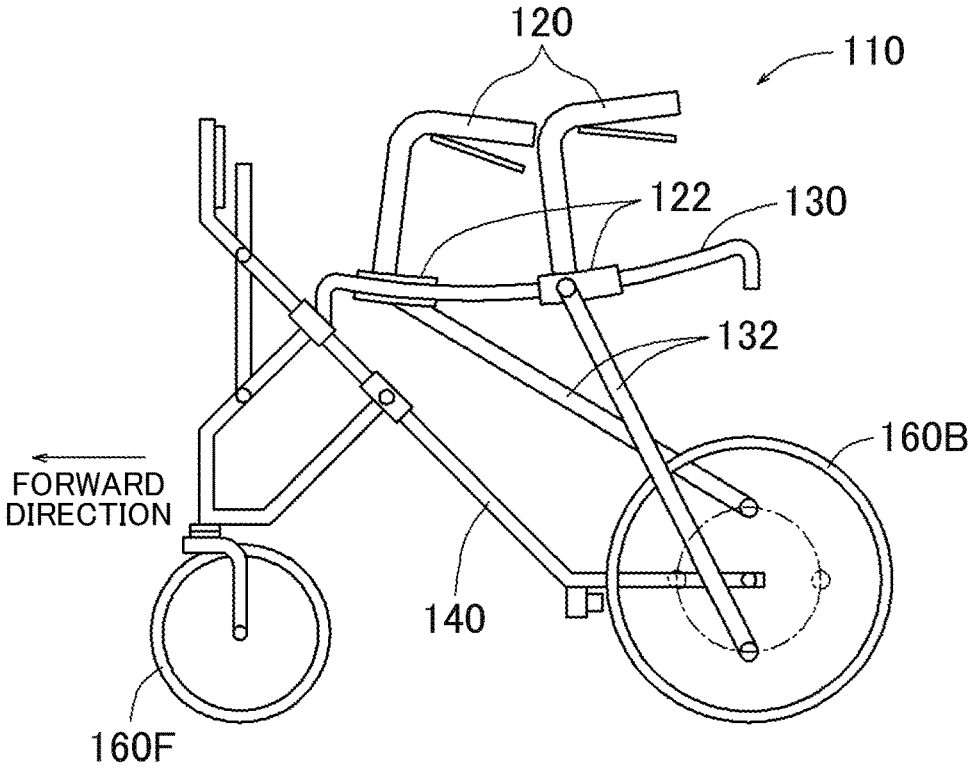
FIG. 9 is a left side view illustrating the overall configuration of a walking assist device (walking cart) according to the related art.
Figure 10:
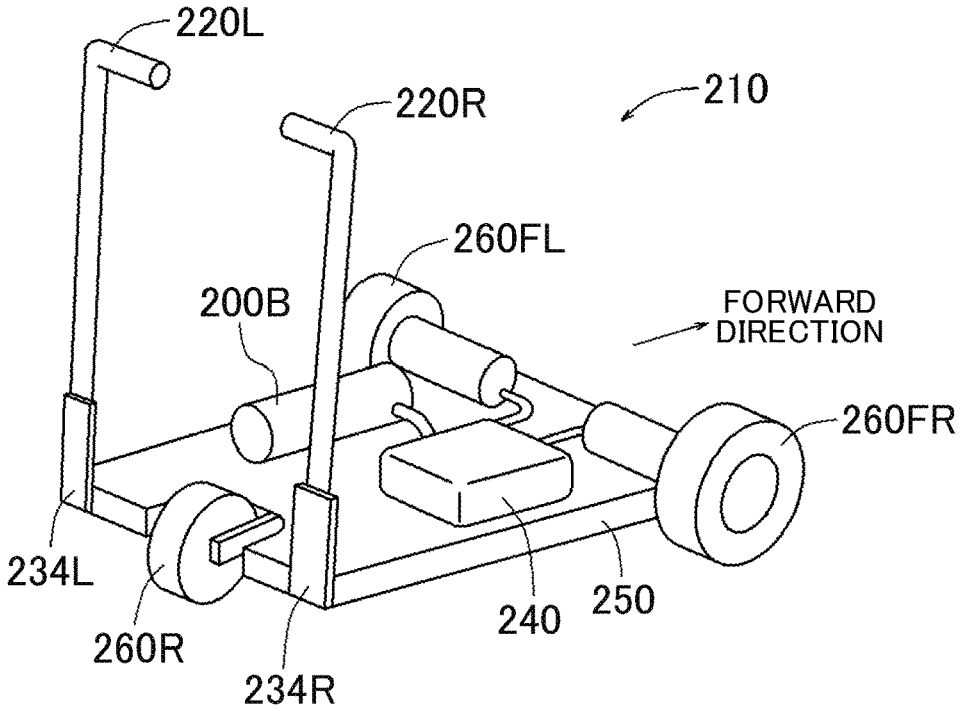
FIG. 10 is a perspective view illustrating the overall configuration of a walking assist device (walking helping device) according to the related art.

FIG. 8 illustrates an amount of movement ΔL1 of the handle from the front side toward the rear side and an amount of movement ΔL2 of the walking assist device 10 toward the front side in the straight travel mode which matches the amount of movement ΔL1 of the handle. The left hand of the user, the handle 20L, and the frame 50 before movement are represented by the long dashed double-short dashed line, and the handle 20L which has been moved from the front side toward the rear side by the amount of movement ΔL1 is represented by the continuous line.

The drive units 64R and 64L (see FIG. 1) are controlled by computing the amount of movement ΔL2 (or the movement speed) in the straight travel mode, which matches the amount of movement ΔL1 (or the movement speed) of the handle 20L, through control performed by the control unit 40 discussed above. By making the amount of movement ΔL2 (or the movement speed) in the straight travel mode equal to the amount of movement ΔL1 (or the movement speed) of the handle 20L, it is possible to simulate walking with poles for skiing or the like, which allows training for high-quality natural walk, in which the arms are swung correctly in synchronization with the legs. In this case, the control unit controls the drive units such that the walking assist device travels forward (by the amount of movement ΔL2) by an amount corresponding to movement of the handles (by the amount of movement ΔL1) with respect to the rails (corresponding to the handle guide units).

A route R1 is the path of the handle 20L which is grasped by the user and moved from the front side toward the rear side along the rail 30L. A route R2 is the path of the handle 20L which is grasped by the user and moved from the rear side toward the front side over the rail 30L. The grip portion 26*a* (see FIG. 3) of the handle 20L is expandable and contractible up and down, which enables the handle 20L to trace the route R2. The route R1 and the route R2 allow the handle to trace a path that is equivalent to the path of the handle in walking with poles for skiing or the like. That is, it is possible to simulate walking with poles for skiing or the like also in the movement path of the handle, which allows training for high-quality natural walk, in which the arms are swung correctly in synchronization with the legs.

As has been described above, the drive wheels are driven by the drive units of the walking assist device in accordance with swing of the arms of the user by controlling the drive units in accordance with information related to movement of the handles which are grasped by the user (e.g. the width of front-rear swing). Thus, it is possible to reduce a burden on the user, since the walking assist device has the drive units which serve as a power source. The arm swing width is not fixed, and it is only necessary for the user to swing his/her arms with a natural swing width that matches his/her own stride length. Thus, it is possible to appropriately assist the user in performing training for high-quality natural walk, in which the user swings his/her arms correctly in synchronization with his/her legs in a correct posture with his/her body trunk straight.

In the present embodiment, the walking assist device is a four-wheeled vehicle with two drive wheels. However, the walking assist device may be a three-wheeled vehicle with one front wheel and two rear wheels, in which the front wheel serves as a drive wheel and the two rear wheels serve as caster wheels. That is, it is only necessary that the walking assist device should have at least one drive wheel.

In the description of the present embodiment, the rails 30R and 30L are shaped to be concavely curved upward. However, the rails 30R and 30L may have a straight shape. In addition, the walking assist device described in relation to the present embodiment includes rails and handles, and the handles are moved in the front-rear direction along the rails. However, handles may be provided at the respective distal ends of pole-like members provided swingably to project from rotary shafts provided on the frame, instead of the rails, and the handles may be swung in the front-rear direction with respect to the frame.

What is claimed is:

1. A walking assist device comprising:

a frame;

a plurality of wheels provided at a lower end of the frame and including a drive wheel;

a drive motor that drives the drive wheel;

a battery that causes the drive motor to operate;

a handle that is grasped by a user and that is movable back and forth with respect to the frame in accordance with an arm swing performed during walk of the user;

a rail on which the handle is provided and which guides the handle in a movable range in accordance with the arm swing performed during the walk of the user;

a handle information acquisition unit that acquires information on the handle; and a control unit is configured to control the drive motor based on the information acquired by the handle information acquisition unit, wherein:

the handle information acquisition unit includes a grasp detection unit that detects presence or absence of a grasp on the handle by the user;

the frame or the rail is provided with a handle movement limiting unit that permits and prohibits movement of the handle with respect to the frame; and the control unit is configured to determine whether or not the handle is grasped by the user based on information from the grasp detection unit, control the handle movement limiting unit so as to permit the movement when it is determined that the handle is grasped, and control the handle movement limiting unit so as to prohibit the movement when it is determined that the handle is not grasped.

2. The walking assist device according to claim 1, wherein:

the control unit is configured to determine whether or not the handle is grasped by the user based on information from the grasp detection unit, unlock the drive wheel when it is determined that the handle is grasped, and lock the drive wheel when it is determined that the handle is not grasped.

3. The walking assist device according to claim 1, wherein:

the rail includes a pair of right and left rails provided on the frame to limit movement of the handle in the movable range in accordance with the arm swing performed during the walk; and the handle is provided on the pair of right and left rails to project upward so as to be slidable along the pair of right and left rails, and has an expansion and contraction mechanism that enables expansion and contraction in a projection direction.

4. The walking assist device according to claim 1, wherein:

the drive wheel is a pair of right and left drive wheels independently driven by a right drive motor and a left device motor; and the control unit is configured to determine whether or not the user desires a right turn or a left turn based on the information from the handle information acquisition unit, and control the right drive motor and the left drive motor such that there occurs a difference between respective rotational speeds of the right and left drive wheels when it is determined that the user desires a right turn or a left turn.

5. The walking assist device according to claim 1, wherein the rail is provided with a load unit that generates a load on movement of the handle, and an assist motor that generates an assist force for assisting the movement of the handle.

6. The walking assist device according to claim 1, wherein the control unit controls the drive motor such that the walking assist device travels forward by an amount corresponding to movement of the handle with respect to the rail based on the information from the handle information acquisition unit.

* * * * *